US005823526A

United States Patent [19]

Voge et al.

[11] Patent Number: 5,823,526

[45] Date of Patent: Oct. 20, 1998

[54] SHEET DELIVERY FOR A SHEET-FED PRINTING PRESS

[75] Inventors: Michael Voge, Malsch; Roland Hirth, Römberg; Gerhard Pollich, Heidelberg, all of Germany

[73] Assignee: Heidelberger Druckmaschinen AG, Heidelberg, Germany

[21] Appl. No.: 679,983

[22] Filed: Jul. 15, 1996

[30] Foreign Application Priority Data

Jul. 14, 1995 [DE] Germany ..... 195 25 635.2

[51] Int. Cl.[6] ..... B65H 29/04

[52] U.S. Cl. ..... 271/204; 198/839; 198/841

[58] Field of Search ..... 271/204, 206, 271/277; 198/839, 841

[56] References Cited

U.S. PATENT DOCUMENTS

| | | | |
|---|---|---|---|
| 2,576,013 | 11/1951 | Haskin . | |
| 3,186,709 | 6/1965 | Peyrerune | 271/206 |
| 3,853,315 | 12/1974 | Dahlgren . | |
| 4,470,593 | 9/1984 | Halff et al. . | |
| 4,562,921 | 1/1986 | Leemkuil et al. | 498/841 |
| 5,056,773 | 10/1991 | Weisgerber . | |
| 5,267,510 | 12/1993 | Hartung et al. . | |

FOREIGN PATENT DOCUMENTS

| | | |
|---|---|---|
| 32537 | 10/1884 | Germany . |
| 34 09 314 | 9/1982 | Germany . |
| 80 31209 | 5/1984 | Germany . |
| 41 31 887 | 1/1993 | Germany . |
| 391 739 | 9/1965 | Switzerland . |
| 973 040 | 10/1964 | United Kingdom . |
| 973040 | 10/1964 | United Kingdom . |

*Primary Examiner*—Boris Milef
*Attorney, Agent, or Firm*—Herbert L. Lerner; Laurence A. Greenberg

[57] ABSTRACT

Sheet delivery for a sheet-fed printing press having gripper systems arranged on conveyor chains or toothed belts revolvingly guided and driven by guide wheels, the gripper systems being activatable by a locally fixed control member for gripping sheets individually at respective leading edges thereof and for releasing the sheets in vicinity of a sheet pile, and including guideways for slidingly guiding the conveyor chains, includes rollers with roller bearings fastened to the conveyor chains or toothed belts, the rollers, in regions of increased load, being movable into separate roller guides arranged on a frame of the printing press, for transmitting to the printing-press frame forces which act upon the conveyor chains or toothed belts.

13 Claims, 4 Drawing Sheets

1
2
3
3
10
10
11
12
A
B
C 13
103
15
14
5

SHEET DELIVERY FOR A SHEET-FED PRINTING PRESS

BACKGROUND OF THE INVENTION

FIELD OF THE INVENTION

The invention relates to a sheet delivery for a sheet-fed printing press having gripper systems arranged on conveying chains revolvingly guided and driven by guide wheels, the gripper systems being activatable by a locally fixed control member, particularly a gripper-opening cam, for gripping sheets individually at respective leading edges thereof and for releasing the sheets in vicinity of a sheet pile, and including guideways for slidingly guiding the conveying chains.

From the published German Patent Document DE 34 09 314 C2, it has become known heretofore to assign a stationary, parabolic lower and upper support element to a chain guide wheel or sprocket wheel in chain entry and exit regions, and to arrange, in the reversing and exit region of a gripper carriage of a gripper system, a spiral-shaped first curved part having a high rate of climb or slope, a spiral-shaped second curved part having a low rate of climb or slope and serving as a transitional member, and an exit part following a higher exponential function. By means of these additional support elements and the particular shaping or form thereof, a reduction in the dynamic and wear-promoting additional forces occurring on conveying chains in the vicinity of the sheet delivery during the slow-down or deceleration of the gripper system and the subsequent acceleration thereof is sought to be achieved.

The German Utility Model DE-GM 80 31209 describes a gripper system with a gripper carriage having a gripper bar whereon sheet grippers are formed, with support rollers being provided on both sides of the press or sheet-processing machine for preventing a tilting or tipping movement of the gripper system about a horizontal axis extending transversely to the sheet transport direction, the support rollers having a slide bearing and rolling off on a skid way in the vicinity of processing stations.

U.S. Pat. No. 5,056,773 discloses a chain guide for a sheet delivery. The chain guide is formed as a C-profile section, end surfaces of mutually opposite flanks or legs of the C-profile forming runways for chain rollers which are arranged on pins of the conveying chains.

SUMMARY OF THE INVENTION

It is accordingly an object of the invention to provide a sheet delivery for a sheet-fed printing press of the foregoing general type which has a functional reliability much improved over corresponding constructions of the prior art, and which simultaneously operates with a low noise level and a minimum of wear and tear.

With the foregoing and other objects in view, there is provided in accordance with the invention, a sheet delivery for a sheet-fed printing press having gripper systems arranged on conveyor chains revolvingly guided and driven by guide wheels, the gripper systems being activatable by a locally fixed control member for gripping sheets individually at respective leading edges thereof and for releasing the sheets in vicinity of a sheet pile, and including guideways for slidingly guiding the conveyor chains, comprising rollers with roller bearings fastened to the conveyor chains, the rollers, in regions of increased load, being movable into separate roller guides arranged on a frame of the printing press, for transmitting to the printing-press frame forces which act upon the conveyor chains.

In accordance with another feature of the invention, the sheet delivery includes guide elements for the rollers with the roller bearings fastened to the conveyor chains, the guide elements being arranged in at least one region selected from a group of regions consisting of a region at which a gripper-opening cam acts upon sheet grippers of the gripper system, regions of conveyor-chain guide wheels, and regions of a conveyor-chain deflection.

In accordance with a further feature of the invention, the rollers with the roller bearings are disposed in a region wherein gripper systems are arranged on the conveyor chains.

In accordance with an added feature of the invention, the rollers with the roller bearings are arranged at a gripper bar.

In accordance with an additional feature of the invention, the rollers with the roller bearings are arranged in pairs at each side of the printing press in the vicinity of a gripper bar.

In accordance with yet another feature of the invention, the sheet delivery includes a guide element for the rollers with the roller bearings fastened to the conveyor chains, the guide element being of shell-shaped construction and being disposed only on a side which is in a direction in which increased loads act.

In accordance with yet a further feature of the invention, the sheet delivery includes an interrupted sliding guide for the conveyor chains in a region of the guide elements for the rollers with the roller bearings fastened to the conveyor chains.

In accordance with yet an added feature of the invention, the sheet delivery includes chain guides for the conveyor chains, and, in at least one of the regions of the conveyor-chain guide wheels and of the conveyor-chain deflection, the chain guides and the guide elements are so arranged that, in the vicinity of a gripper bar, loads are clearly transmitted to the guide elements, and the chain guides are markedly relieved.

In accordance with yet an additional feature of the invention, the chain guides for the conveying chains and the guide elements form a structural unit and are comprised of bars having a C-profile.

In accordance with still another feature of the invention, the chain guides, respectively, for the conveying chains are flexibly connected to side walls of the printing-press frame.

In accordance with still a further feature of the invention, the sheet delivery includes a stud connected to a side wall of the printing-press frame, the stud being fastened to a cross-bar secured by screws to the chain guide, respective axes of the screws being arranged eccentrically to the axis of the stud, the stud extending into a recess formed in the side wall and being connected by a screw to the side wall at a bottom of the recess.

In accordance with still an added feature of the invention, the chain guide and the guide elements define equidistant courses of curves.

In accordance with still an additional feature of the invention, the chain guide, in the regions wherein the guide elements for the rollers are arranged, are formed of synthetic material.

In accordance with a concomitant aspect of the invention, there is provided a sheet delivery for a sheet-fed printing press having gripper systems arranged on toothed belts revolvingly guided and driven by guide wheels, the gripper systems being activatable by a locally fixed control member for gripping sheets individually at respective leading edges thereof and for releasing the sheets in vicinity of a sheet pile, and including guideways for slidingly guiding the toothed belts, comprising rollers with roller bearings fastened to the toothed belts, the rollers, in regions of increased load, being movable into separate roller guides arranged on a frame of the printing press, for transmitting to the printing-press frame forces which act upon the toothed belts.

Thus, an essential feature of this invention is the arrangement of a roller bearing support for the conveyor chains in regions of increased load, in order thereby to lower the noise level, and to transmit the developing forces with reduced friction onto runways connected with the printing-press frame. Accordingly, guides for rollers with roller bearings are preferably arranged in the region of a gripper-opening cam acting upon the grippers of the gripper systems on the conveyor chains, in the region of a conveyor-chain guide, and possibly also in the region of a conveyor-chain deflection.

The construction according to the invention includes a further feature of C-profile chain guides attached to the side walls of the printing press so as to have flexural properties. In this manner, strong shocks and an increase in consequent noise level are prevented by the introduction or dissipation of the forces acting upon the conveyor chains into the printing-press frame. In a preferred embodiment of this flexible attachment of the C-profile chain guides to the printing-press side walls, a stud is fastened to a crossbar. By means of two screws, the axes of which are arranged eccentrically to the axis of the stud, the crossbar is fastened to the guide, and the stud extends into a recess of the side wall. In this manner, a soft, flexible attachment of the C-profile of the chain guides to the printing-press frame is achieved, due to which heavy shocks acting upon the conveying chains are dampened.

Other features which are considered as characteristic for the invention are set forth in the appended claims.

Although the invention is illustrated and described herein as embodied in a sheet delivery for a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
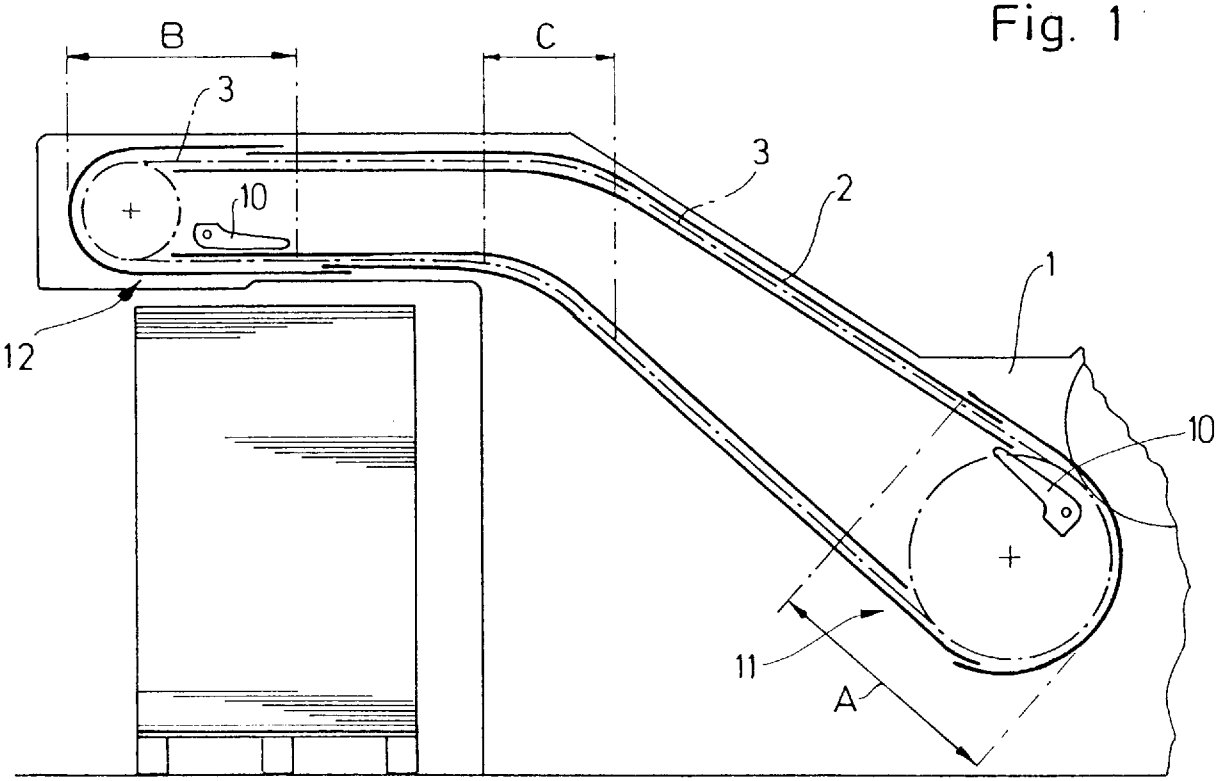
FIG. 1 is a side elevational view of a sheet delivery for a printing press constructed in accordance with the invention.
Figure 2:
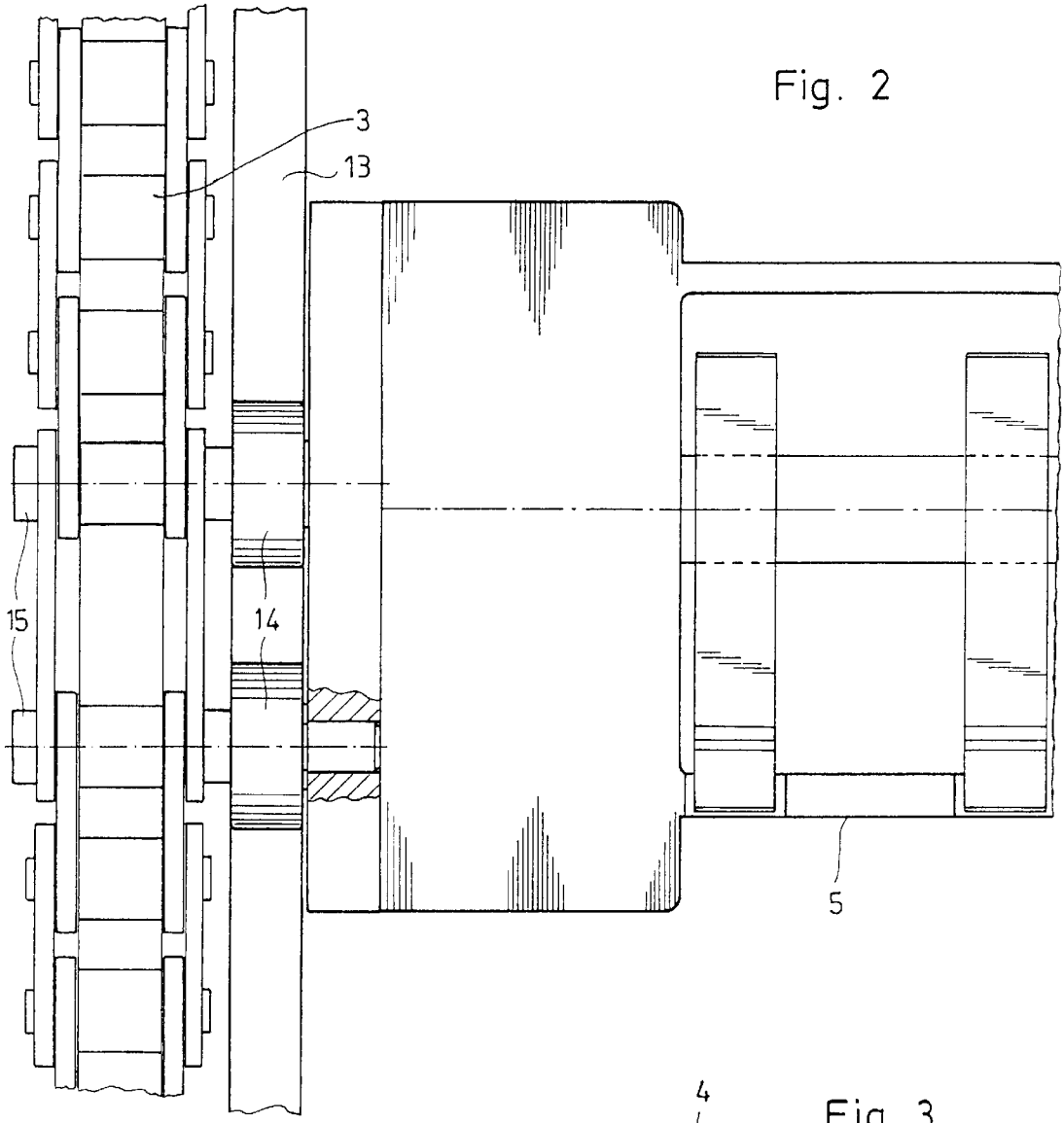
FIG. 2 is a much-enlarged fragmentary, top plan view of one end of a gripper system revolving on conveying chains in the sheet delivery of FIG. 1.
Figure 3:
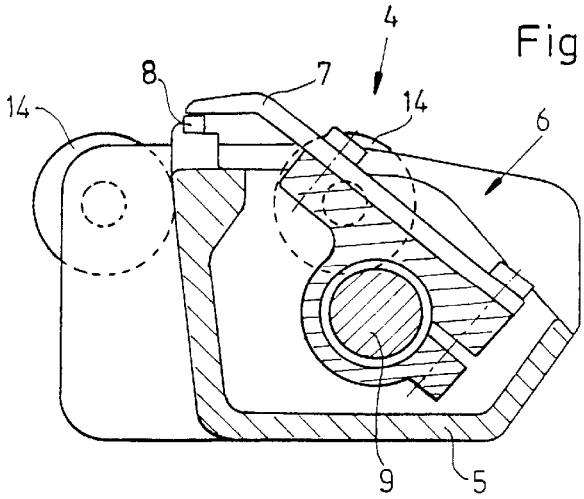
FIG. 3 is a cross-sectional view of the gripper system of FIG. 2 taken along the line III—III in the direction of the arrows.

Referring now to the drawings and, first, particularly to FIGS. 1 to 3 thereof, chain guides 2 for endless, revolving conveyor chains 3 are shown therein, attached to the inside of side walls 1 of a printing-press frame, at both sides of the press. On the two conveyor chains 3, which revolve in parallel adjacent to one another, uniformly spaced-apart gripper systems 4 are provided which are formed of a gripper bar 5 fastened to both conveyor chains 3, and sheet grippers 6 fastened to the gripper bar 5. FIG. 3 shows a sheet gripper 6 formed of a gripper finger 7 and a gripper pad 8. The gripper finger 7 is attached to a gripper shaft 9 arranged so as to be swivellable counter to the force of a spring, the gripper finger 7 cooperating with a gripper pad 8 fixedly disposed on the gripper bar 5. The sheet gripper 6 is openable for releasing a sheet, which is clamped by an edge thereof between the gripper finger 7 and the gripper pad 8, due to the action of an otherwise non-illustrated cam roller arranged on the gripper shaft 9, the cam roller cooperating with a fixedly arranged gripper-opening cam 10 (FIG. 1). The conveyor chains 3 are guidingly reversed in travel direction by guide wheels 11 and 12 and are guided in the chain guides 2 between the guide wheels 11 and 12. In certain regions, the chain guide 2 is formed of a profile having a C-shaped cross section, as shown in FIG. 1. Mutually opposite end faces of the profile with the C-shaped cross section support the conveyor chains 3, which are formed as sprocket or side-bar chains, between lateral mutually opposing side bars, so that they either slide on the chain pins or roll off on rollers mounted on the chain pins. The location at which the load is transferred from the chain guide 2 to guide elements 13 for rollers or runners 14, or the reverse, is defined in terms of construction by flat angles of approach and exiting.

Figure 4:
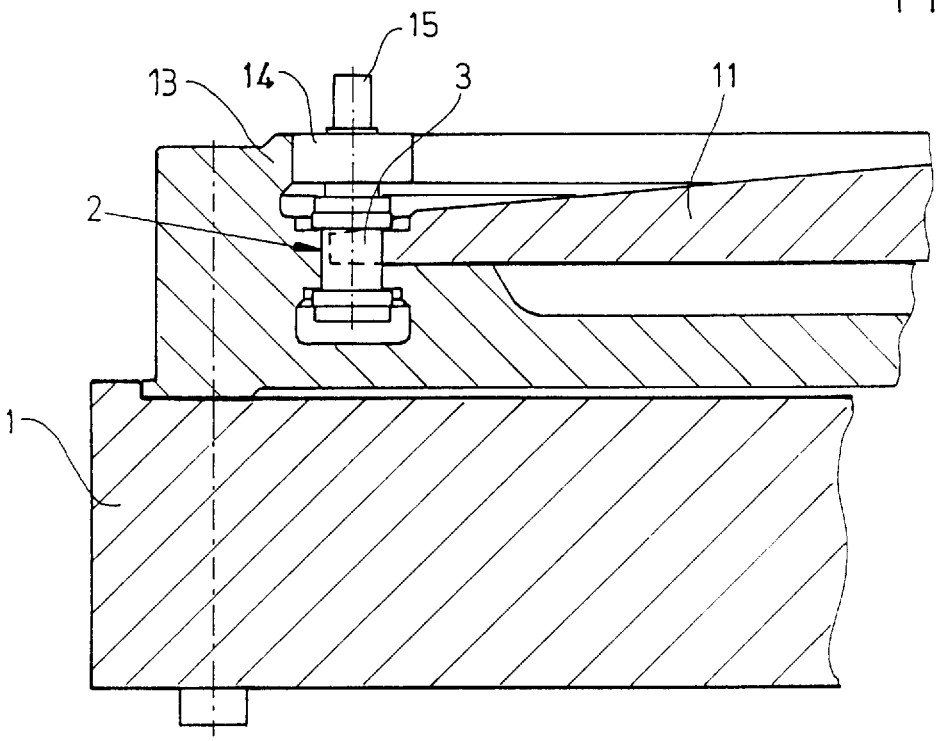
FIG. 4 is a fragmentary sectional view of a chain guide forming part of the invention.

In regions of increased load, preferably in the regions A and B of the conveying chain guide wheels 11 and 12, as well as in the region B of the gripper-opening cam 10 and, if necessary or desirable, also at other locations of increased load C including regions of conveyor chain deflection, additional guide elements 13 are provided with a runway for supporting the rollers or runners 14 with respective roller bearings, the rollers or runners 14 being fastened to the conveyor chains 3. As shown in FIG. 4, these guide elements 13 may, if necessary or desirable, only be arranged on the side in which direction the additional forces act, as they originate, for example, from the gripper-opening cam 10 or from centrifugal forces in the vicinity of the guide wheels 11 and 12. The rollers or runners 14 with the roller bearings, in the exemplary embodiment, are arranged on chain pins 15, which are lengthened at one side thereof, the roller bearings being those shown in the sectional view of FIG. 4. According to the exemplary embodiment, the rollers or runners 14 with the roller bearings are provided at each press side between a respective conveyor chain 3 and the respective end face of the gripper bar 5. The chain guides 2 formed of C-profiled rods and the guide elements 13, preferably form a structural or modular unit.

Preferably, two rollers or runners 14 with roller bearings are arranged in tandem, i.e., behind one another, in the sheet transport direction on each press side, in order to prevent tilting or tipping movements of the gripper system 4 and to achieve a more precise guidance of the gripper system 4 perpendicularly to the sheet transport direction, also under increased load.

Figure 5:
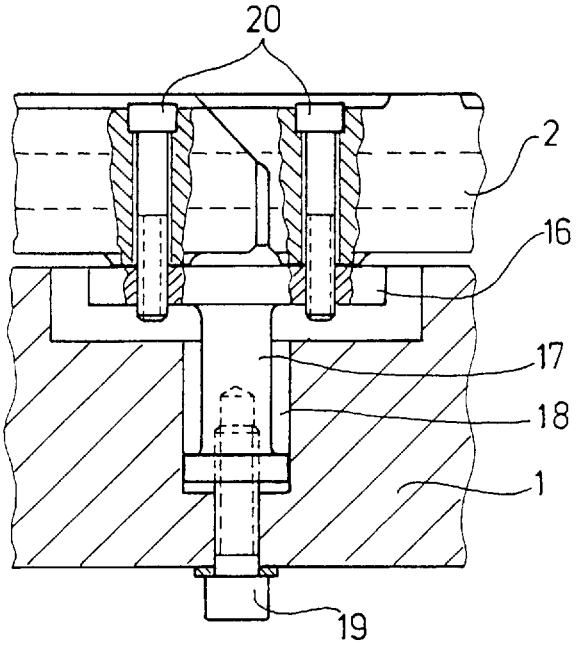
FIG. 5 is a fragmentary cross-sectional view of the chain guide showing the connection thereof to the printing-press frame.

In a further embodiment of the invention, chain guides 2 are provided for the conveyor chains 3, the chain guides 2 being screwed flexibly to the respective side wall 1 of the press frame, as shown in FIG. 5. This is achieved through the interposition of a crossbar 16 to which a stud 17, a pin or the like is fastened, the stud 17 extending into a recess 18, which has a greater sectional dimension than that of the stud 17, formed in the side wall 1, the bottom of the stud 17 being screwed to the bottom of the recess 18 in the side wall 1 by means of a screw 19. The crossbar 16 is fastened to the chain guide 2 for the conveyor chain 3 in two places by means of screws 20, so that it is positioned spaced from and eccentric to the central longitudinal axis of the stud 17. Thus, the connection between the chain guide 2 and the side wall 1 of the press frame is flexible, the flexural quality or elasticity of this connection being determined by the choice of the dimensions and material of the crossbar 16 and the stud 17.

Deviating from the illustration in FIG. 4, bar-shaped C-profile members are preferably used for creating the flexible connection between the chain guide 2 and the side wall 1, as is illustrated in FIG. 5.

Figure 2A:
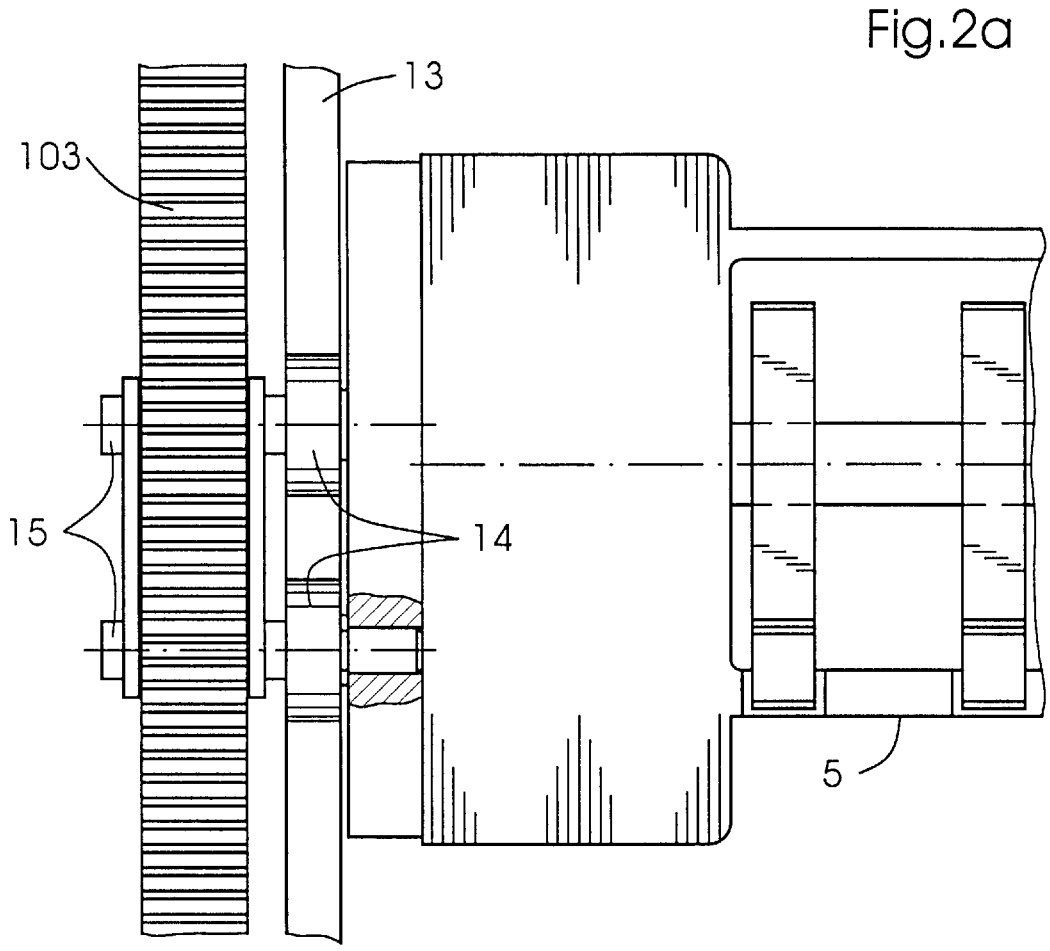
FIG. 2*a* is a much-enlarged fragmentary, top plan view of one end of the gripper system revolving on a conveying belt in the sheet delivery of FIG. 1.

Through the features of this invention, not only are wear and tear and noise reduced, but also, less lubricating oil is required, a fact which offers an ecological advantage. For the heavily loaded locations of the chain guide 2, roller bearings are provided, so that the more lightly loaded guide parts may, if necessary or desirable, be formed of synthetic material and, in fact, both elements for the chain guides 2, as well as elements for the roller bearings may thus be formed of synthetic material. For the same reason, toothed belts 103 as shown in FIG. 2*a* may be used instead of conveyor chains, because the pulling or tensile forces in the conveying means are also being reduced by the application of the features of this invention. Toothed belts are generally made of synthetic material, require less lubricant and cause less noise.

We claim:

1. Sheet delivery for a sheet-fed printing press, comprising:

guide wheels;

conveyor chains revolvingly guided and driven by said guide wheels;

gripper systems disposed on said conveyor chains;

a locally fixed control member, said gripper systems being activatable by said locally fixed control member for gripping sheets individually at respective leading edges thereof and for releasing the sheets in vicinity of a sheet pile;

guideways for slidingly guiding said conveyor chains;

separate roller guides arranged on a frame of the printing press;

rollers with roller bearings fastened to said conveyor chains, said rollers, in regions of increased load, being movable into said separate roller guides arranged on a frame of the printing press, for transmitting to the printing press frame forces which act upon said conveyor chains; and said separate roller guides having guide elements being of concave construction and said guide elements being disposed only on a side which is in a direction in which increased loads act.

2. Sheet delivery according to claim 1, wherein said guide elements being arranged in at least one region selected from a group of regions consisting of a region at which a gripper-opening cam acts upon sheet grippers of the gripper system, regions of said guide wheels, and regions of deflection of said conveyor chains.

3. Sheet delivery according to claim 2, wherein said rollers with said roller bearings are disposed in a region wherein said gripper systems are arranged on said conveyor chains.

4. Sheet delivery according to claim 2, including a gripper bar and said rollers with said roller bearings are disposed at said gripper bar.

5. Sheet delivery according to claim 2, including a gripper bar and said rollers with said roller bearings are disposed in pairs in a vicinity of said gripper bar.

6. Sheet delivery according to claim 2, wherein said guideways for slidingly guiding said conveyor chains is interrupted in a region of said guide elements for said rollers with said roller bearings fastened to the conveyor chains.

7. Sheet delivery according to claim 2, including chain guides for said conveyor chains and a gripper bar, and wherein, in at least one of said regions of said guide wheels and of said conveyor chain deflection, said chain guides and said guide elements are so disposed that, in a vicinity of said gripper bar, loads are transmitted to said guide elements, and said chain guides are relieved.

8. Sheet delivery according to claim 7, wherein said chain guides for said conveyor chains and said guide elements form a structural unit and are comprised of bars having a C-profile.

9. Sheet delivery according to claim 8, wherein said chain guides, respectively, for said conveyor chains are flexibly connected to side walls of the printing-press frame.

10. Sheet delivery according to claim 9, including a stud connected to at least one of said side walls, said stud being fastened to a crossbar secured by screws to at least one of said chain guides, respective axes of said screws being arranged eccentrically to the axis of said stud, said stud extending into a recess formed in the at least one side wall and being connected by a screw to the at least one side wall at a bottom of said recess.

11. Sheet delivery according to claim 8, wherein said chain guide and said guide elements define equidistant courses of curves.

12. Sheet delivery according to claim 8, wherein said chain guide, in said regions wherein said guide elements for said rollers are arranged, are formed of synthetic material.

13. A Sheet delivery for a sheet-fed printing press, comprising:

guide wheels;

toothed belts revolvingly guided and driven by said guide wheels;

gripper systems disposed on said toothed belts;

a locally fixed control member, said gripper systems being activatable by said locally fixed control member for gripping sheets individually at respective leading edges thereof and for releasing the sheets in vicinity of a sheet pile;

guideways for slidingly guiding said toothed belts;

separate roller guides arranged on a frame of the printing press;

rollers with roller bearings fastened to said toothed belts, said rollers, in regions of increased load, being movable into said separate roller guides arranged on a frame of the printing press, for transmitting to the printing press frame forces which act upon said toothed belts; and said separate roller guides having guide elements being of concave construction and said guide elements being disposed only on a side which is in a direction in which increased loads act.

* * * * *